US006085567A

United States Patent [19]

Cattaneo et al.

[11] Patent Number: 6,085,567

[45] Date of Patent: Jul. 11, 2000

[54] ROLLING STAND HAVING CROSSED ROLLS WITH VARIABLE SETTING

[75] Inventors: Filippo Cattaneo; Cesare Maiandi; Antonino Rossi, all of Milan, Italy

[73] Assignee: Demag Italimpianti SpA, Milan, Italy

[21] Appl. No.: 09/115,235

[22] Filed: Jul. 14, 1998

[30] Foreign Application Priority Data

Jul. 24, 1997 [IT] Italy ..... MI97A1760

[51] Int. Cl.[7] ..... B21B 31/00

[52] U.S. Cl. ..... 72/237; 72/241.2; 72/247; 72/241.8

[58] Field of Search ..... 72/237, 241.2, 72/247, 248, 241.4, 241.8

[56] References Cited

U.S. PATENT DOCUMENTS

| | | | |
|---|---|---|---|
| 4,453,393 | 6/1984 | Hino et al. . | |
| 4,907,439 | 3/1990 | Diel et al. | 72/241.2 |
| 5,291,770 | 3/1994 | Koujin et al. | 72/237 |
| 5,365,764 | 11/1994 | Kajiwara et al. | 72/241.2 |
| 5,765,422 | 6/1998 | Donini et al. | 72/237 |
| 5,860,309 | 1/1999 | Drigani | 72/237 |

FOREIGN PATENT DOCUMENTS

| | | |
|---|---|---|
| 56-131004 | 10/1981 | Japan . |
| 59-110406 | 6/1984 | Japan . |
| 60-162512 | 8/1985 | Japan . |
| 4-361802 | 12/1992 | Japan . |
| 2141959 | 1/1985 | United Kingdom . |
| 92/02320 | 2/1992 | WIPO . |

OTHER PUBLICATIONS

Shunji Kamada et al.; Edge Profile Control Using Pair Cross Mill in Cold Rolling; Iron and Steel Engineer; Jun., 1996; pp. 20–26.

*Primary Examiner*—Ed Tolan
*Attorney, Agent, or Firm*—Pillsbury Madison & Sutro LLP

[57] ABSTRACT

The invention relates to a rolling stand of the type with crossed rolls, for flat products, which comprises at least two working rolls opposed to one another. These rolls are angularly adjustable and such an adjustment is effected by rotating them about a vertical axis of the stand.

Advantageously, the actuators which serve to maintain the working rolls at a predetermined distance from one another following to the thickness of the material to be rolled, are solid with the rotations of the rolls themselves: in this way the stresses which the rolls transmit to the actuators during rolling are independent of their angular adjustment and are therefore always balanced.

14 Claims, 8 Drawing Sheets

ROLLING STAND HAVING CROSSED ROLLS WITH VARIABLE SETTING

The present invention concerns rolling mills with crossed rolls, devised for manufacturing flat products such as sheets, slabs, rolled strips and others. The term "with crossed rolls" is intended to indicate that particular rolling process and the corresponding rolling mills for implementing it, wherein one or more stands laid in succession along the feeding direction of the material to be rolled are equipped with opposed working rolls, having the axes of rotation arranged obliquely with respect to one another.

Indeed, in accordance with an established practice of this technical field, the rolling stands above have at least two rolls, situated respectively on opposite sides of the material to be rolled, which are laid in such a manner that when seen in plan they exhibit a particular "X"-shaped lay out of their axes of rotation.

The technical reasons which justify the use Of these rolling mills have been fully discussed in many technical publications and form the subject of several patents; consequently we shall not deal in more depth hereafter with these arguments, for which reference should be made to the specialized literature. It is only worth pointing out that, in the international scientific field, the rolling process and the relating mills with crossed rolls are known briefly by the term "crossing" which will be used also in the text of this description.

As a further statement about the general state of the art, it should also be remembered that in order to increase the performances of rolling mills with crossed rolls, it is often made in addition to the working rolls with oblique axes, of back up rolls: it is to say that for stiffening the working rolls and to better control the inevitable bending which they undergo during rolling, it is a widespread practice to apply stiffening rolls on the side of the working roll opposite to the one which is in contact with the material to be rolled.

In other words, for each of the two oblique working rolls there is coupled another one along a contact generatrix; a similar arrangement is also known internationally in the art as "pair crossing".

It should also be stated that there are however examples of rolling mills wherein the back up rolls are applied to the corresponding working roll, with axes of rotation which are in turn crossed with respect to the latter roll; from the foregoing, it can therefore be understood that there are numerous possible combinations and developments which are of interest for the rolling process with crossed rolls in general.

An important aspect that concerns the performances of the crossing rolling mills, lies in the manner of adjusting the angle of inclination of the rolls, and which, in the light of the statements just made, may involve both the working rolls and the back up rolls; indeed, such an adjustment should not prejudice another important setting that occurs during rolling: the regulation of the distance of the rolls from the surface to be processed.

For setting this distance, it is known in the art to use hydraulic actuators, also called capsules, or electromechanical actuators, called "setting screws"; these actuators consist in practice of a fixed part rigidly connected to the load-bearing structure of each rolling stand, and a movable part moving to and fro with respect to the other one, in a direction perpendicular to the feeding plane of the material to be rolled. Generally, two actuators are provided for each roll, or pair of rolls in the case of pair crossing, which act in parallel directions on their supporting chocks: in practice, during rolling the actuators or capsules maintain the rolls, which tend to be separated by the forces induced by the material being processed, at a predetermined distance from one another depending on the circumstances (i.e. thickness of the product to be rolled).

However, the variation in the inclination of the working rolls (or the pairs of rolls which they form with the back up ones) effected in order to adjust the angular position mentioned above, causes a variation of the point of application of the force on the fixed support part of the stand.

It is in fact clear that the greater is the inclination of the axes of the rolls with respect to a line transverse to the feeding direction of the material being rolled, the greater is the distance of the point of application of the resultant reaction transmitted by each actuator or capsule mentioned above, from the axis of the respective roll.

In brief, since the actuators in question have a part which is integral with the load-bearing structure of the respective rolling stand, the more the inclination of the rolls increases as a result of their angular adjustment, the more the resultant force which is applied to their support bearings will be displaced with respect to their axis.

The variation of the point of application of the forces referred to above produces stresses in the capsule (or "setting screw") which, if not adequately compensated, may cause malfunctioning of the actuator itself and therefore reduce the performances of the rolling mill; the importance of this fact must be underlined, since rolling mills with crossed rolls are mainly used in the finishing phase of the flat surfaces or strips, that is to say, the steps of the processing in which the definitive dimensional tolerances must be obtained.

An example of rolling stand with crossed rolls which aims to overcome the disadvantages mentioned above, is known from U.S. Pat. No. 4,453,393 in the name of Mitsubishi (Japan); this document describes a rolling stand with crossed rolls and more precisely of the pair crossing type, wherein for compensating the imbalances between the rolling forces transmitted to the rolls due to the material passing through the stand, and those exerted by the pairs of actuators or capsules provided for their vertical setting, a balancing beam is used which extends transversely to the load-bearing structure of the stand.

This beam is guided along the uprights of the above-mentioned structure: it is interposed between the two actuators associated with a pair formed by a working roll with a back up roll, and a casing for housing these rolls wherein the corresponding bearings are arranged.

In practice it can be stated that the principle of operation of this solution lies in the fact that the aforesaid beam constitutes a slidably guided element, sufficiently rigid and with suitable dimensions as to render it capable of absorbing the stresses that occur as a result of the unbalanced forces already mentioned.

Although it should not be excluded that the rolling stand described in the aforesaid U.S. patent is capable of satisfying the requirements for which it is devised, at first sight it has some drawbacks which limit its performance, raising some doubts as to the real possibility of actual application at industrial level.

Firstly, it should be taken into account that the balancing beam must have relevant dimensions, because of the very high forces occurring during the rolling process with crossed rolls (of the order of 2000–4000 tons), which are well known; this means in substance an increase of weight of the rolling stand as well as of its various components which will be dimensioned also in function of the presence of this beam. Secondly, it is necessary to consider that the beam is unavoidably subjected to unbalanced forces exerted by the actuators which press on it from one side, and by the rolls which transmit the rolling forces to their housing from the other side: this imbalance should be compensated to some degree by the torsion of the balancing beam; however it should not be excluded that this may cause difficulties in the sliding of the beam along the uprights of the load-bearing structure of the stand.

It is therefore the object of the present invention to remedy such a situation and the drawbacks connected thereto; this object is achieved by a rolling stands, as well as by a rolling mill comprising one or more of such stands, the characteristics thereof are disclosed in the claims hereby annexed The invention will be better understood in the light of the following detailed description, relating to a preferred and non-exclusive embodiment shown in the accompanying drawings, wherein:

Figure 1:
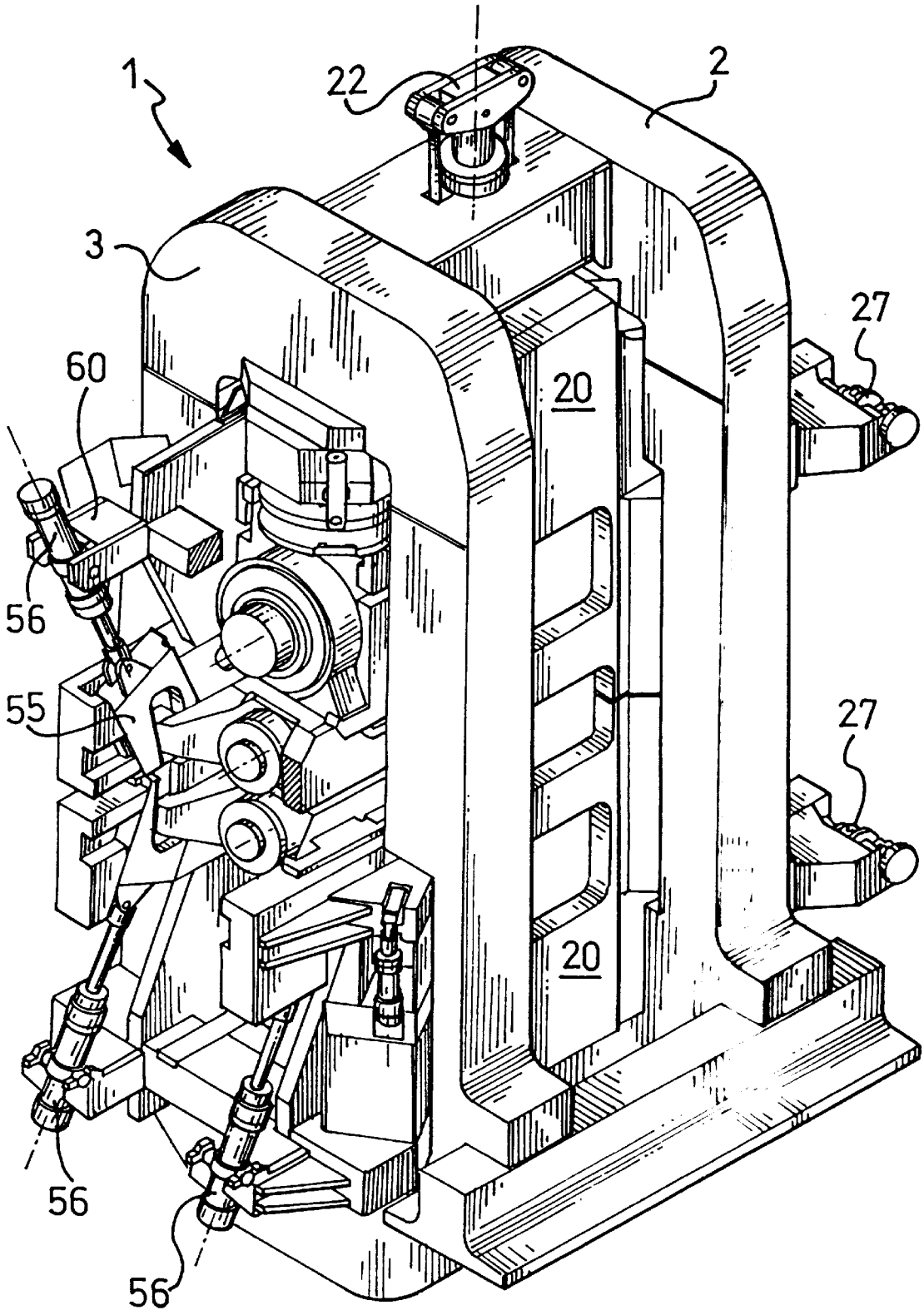
FIG. 1 is an axonometric view of a rolling stand according to the invention.

In these figures, a rolling stand according to the present invention has been indicated as a whole by the reference 1.

It comprises a load-bearing structure consisting essentially of two ring-shaped frames 2, 3 arranged on opposite sides with respect to a vertical axis V of the stand passing through the median part of a strip, slab or other, being rolled; the drawings do not show graphically the product which is rolled but only a horizontal reference direction O, transverse to that of its feeding has been indicated.

The two frames 2 and 3 are rigidly bolted to the ground at the points 4, 5 and, as is clearly visible in the figures, rolling stand 1 is of the pair crossing type: it is to say that on the upper and lower faces of the material to be rolled respectively act two working rolls, indicated by 10 and 12, each associated with a corresponding back up roll 11 and 13.

For the sake of brevity of description in the continuation, reference will be made only to the pair of upper rolls 10 and 11, it being understood however that what is disclosed may apply also to the lower part of the stand wherein rolls 12, 13 are located; the stand 1 should be regarded as substantially symmetrical with respect to the horizontal direction O.

This means that in the rolling stand 1 the lower rolls 12 and 13 are also angularly adjustable like the upper ones 10 and 11, while as regards their positioning in a vertical direction, that is to say the adjustment of their distance from the material being rolled, this is obtained in a conventional manner by inserting or removing shims beneath in order to raise or lower them. Naturally, however, nothing prevents the use for this purpose of actuators like those which will be described in connection with the upper rolls.

Figure 2:
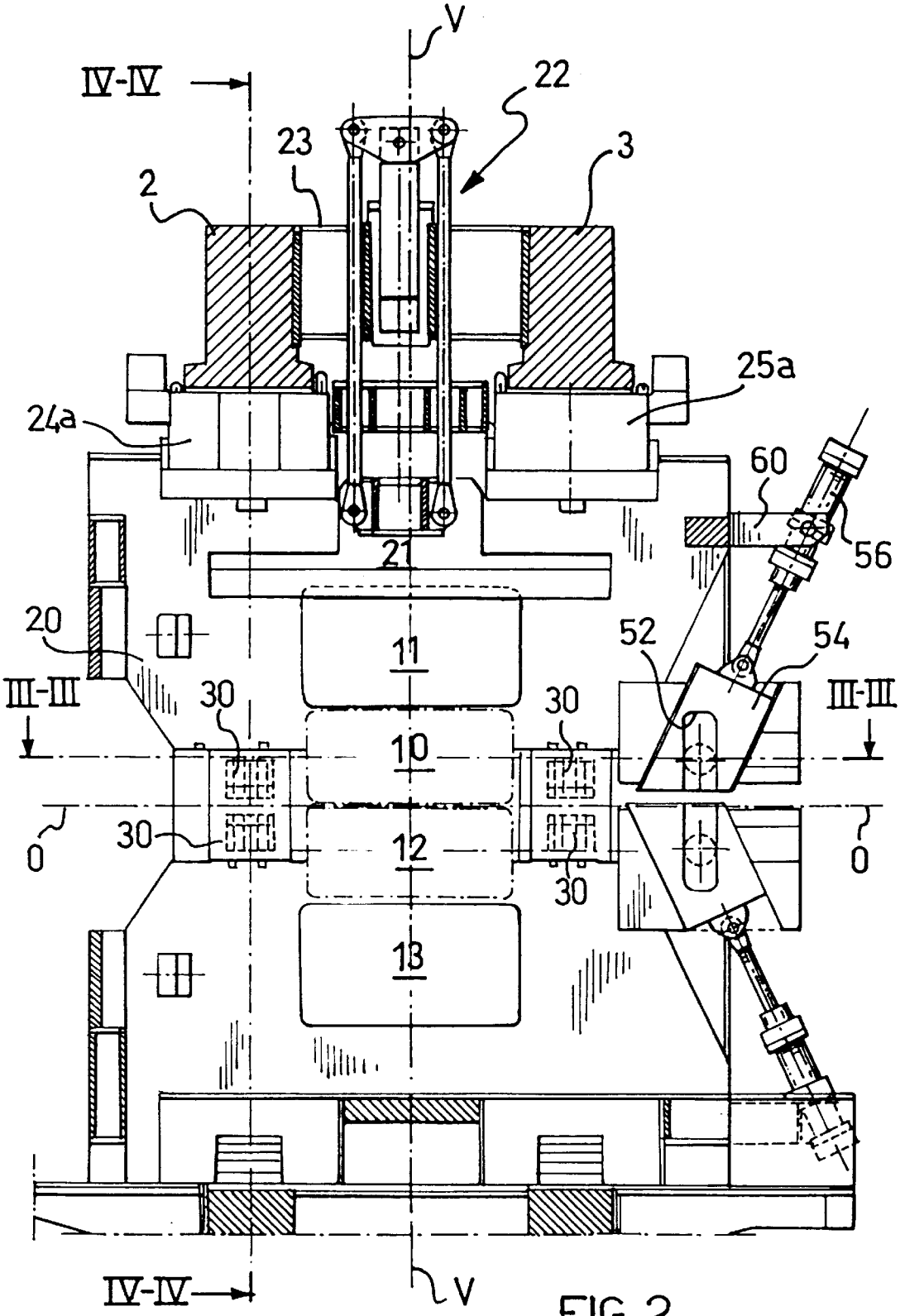
FIG. 2 is a front view, partially cut away, of the rolling stand in FIG. 1.

In the light of this statement, in the drawings (especially FIG. 2) for sake of simplicity no particulars of the lower part of the housing have been shown in detail.

The upper rolls 10 and 11 are mounted in a casing 20 wherein there are also accomodated their chocks with the respective bearings (not numbered in the drawings where they are visible only in FIG. 3 for the working roll 10); in particular, the back up roll 11 is connected to a cross-member 21 arranged transversely to the casing 20 and to which are applied its chocks (not shown in the drawings); the cross-member 21 is supported vertically by an assembly 22 of a mounting 23 which extends between the two frames 2 and 3. The assembly 22 in this case consists of a hydraulic cylinder with two rods hinged to the sides thereof, and passing through the upper face of the casing 20, thereby meeting the cross-member 21 to which they are hinged.

On opposite parts of the casing 20 there are located two hydraulic actuators 24 and 25 intended for setting the distance of the rolls 10 and 11 from the material to be rolled; such actuators comprise a fixed part 24*a* and 25*a* respectively, which will be explained in more detail hereinafter, coupled to a corresponding part 24*b*, 25*b* movable to and fro in a direction parallel to the axis V; the aforesaid movable parts 24*b* and 25*b* act on the chocks of the back up roll 11.

The actuators 24 and 25 are per se analogous to those existing in the state of the art: differently however from what has been shown in U.S. Pat. No. 4,453,393, they are located on the roll-carrying casing 20 and not on the load-bearing structure of the stand; furthermore, their fixed parts 24*a*, 25*a* are arranged on the upper face of the casing 20 so as to be able to act against the inner surface of the frames 2 and 3 during the operation of the stand (see FIGS. 2 and 4).

Figure 3:
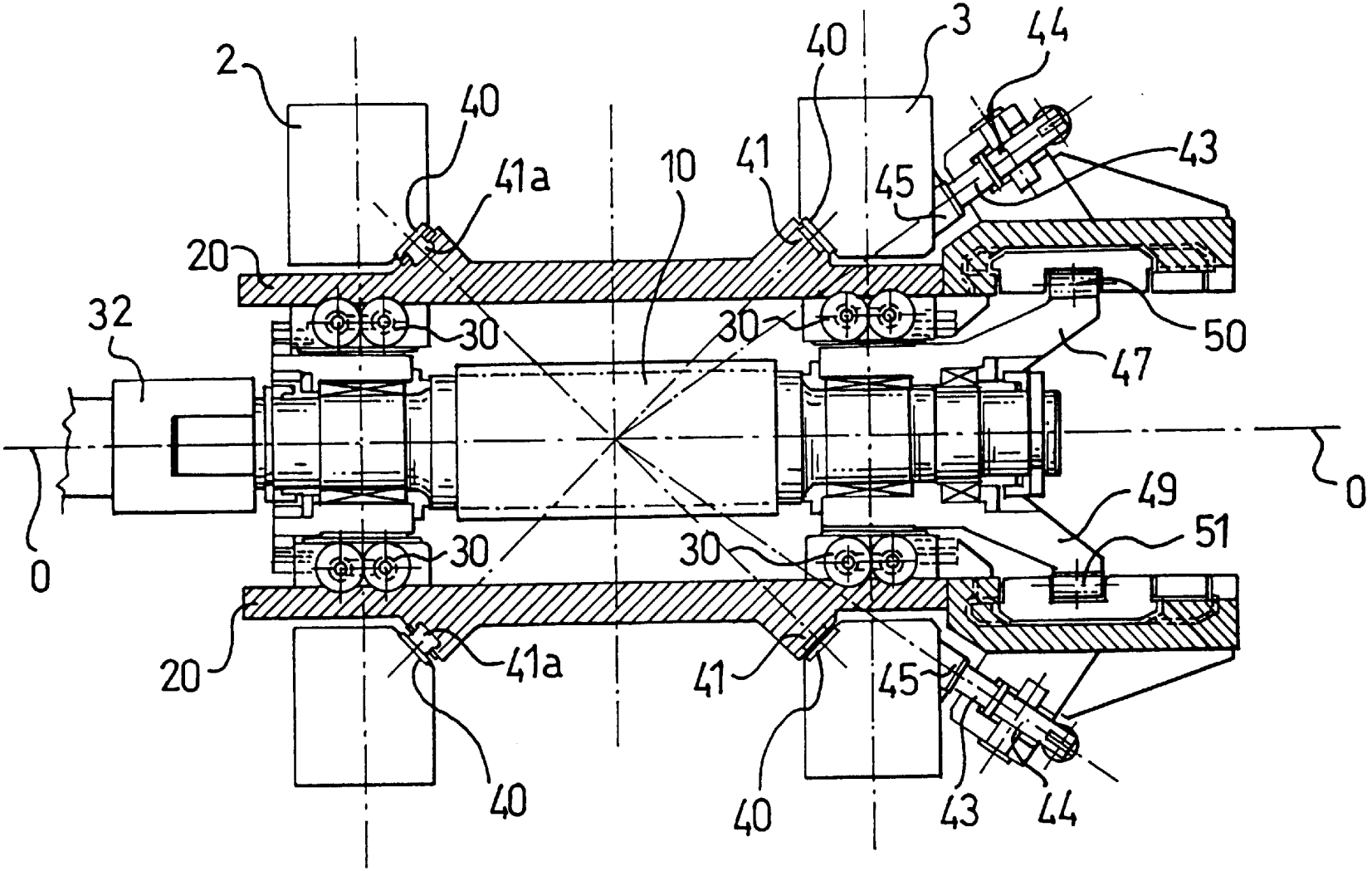
FIG. 3 is a sectional view along the line III—III in FIG. 2, of the rolling stand referred to above.
Figure 5:
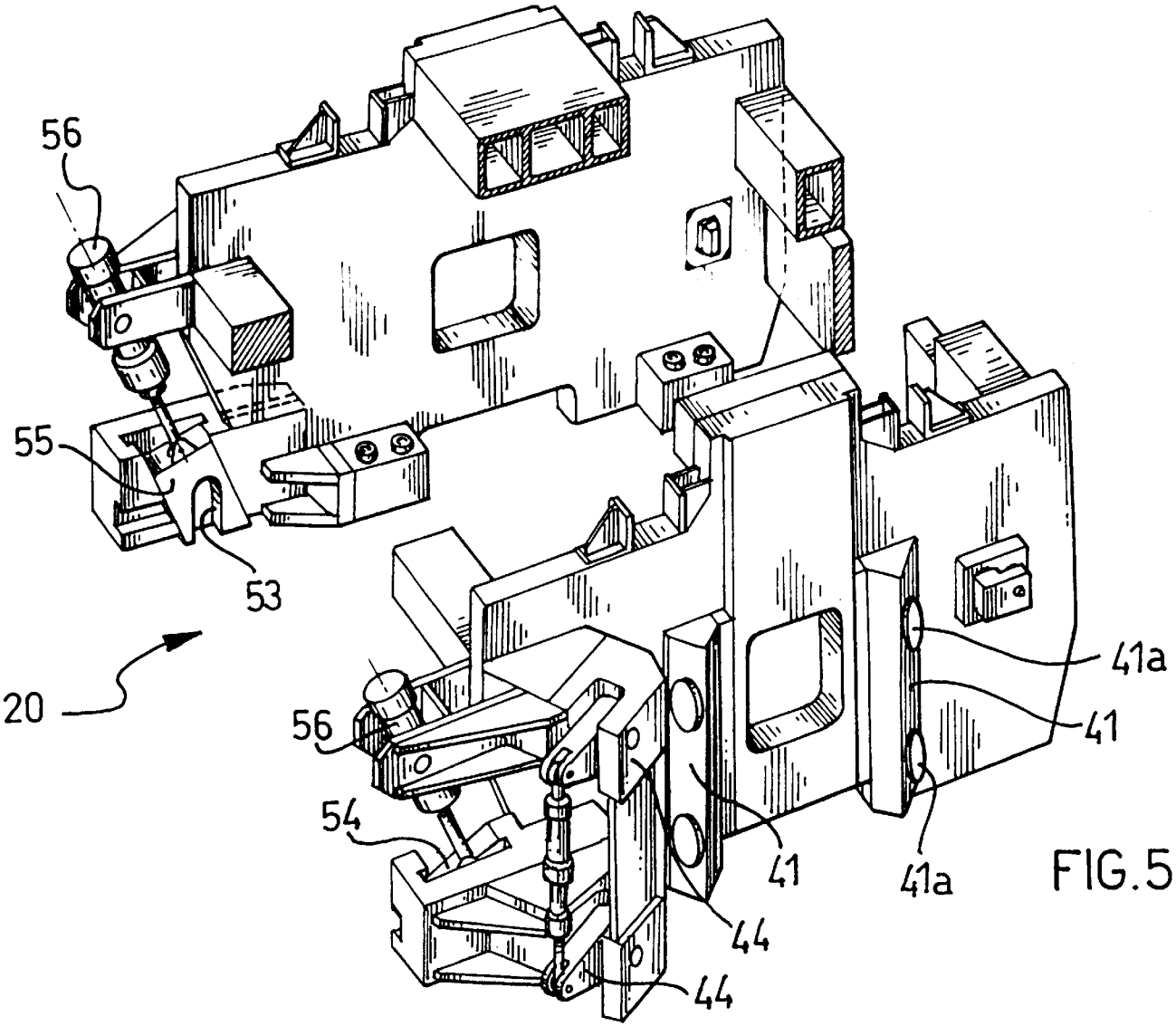
FIG. 5 is a perspective, exploded view of a detail of the stand shown in the preceding figures.
Figure 6:
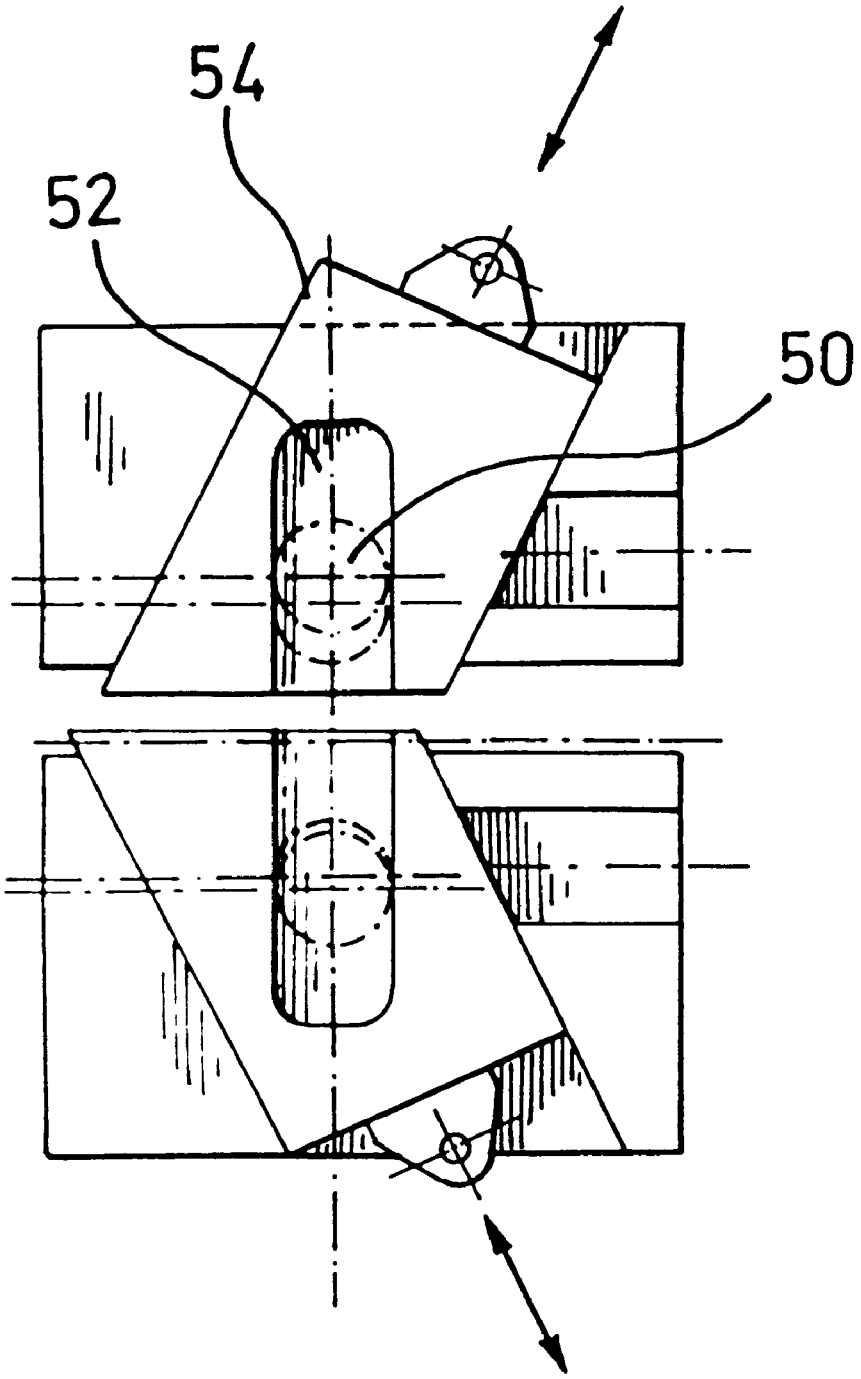
FIG. 6 shows another detail of the above rolling stand.
Figure 7:
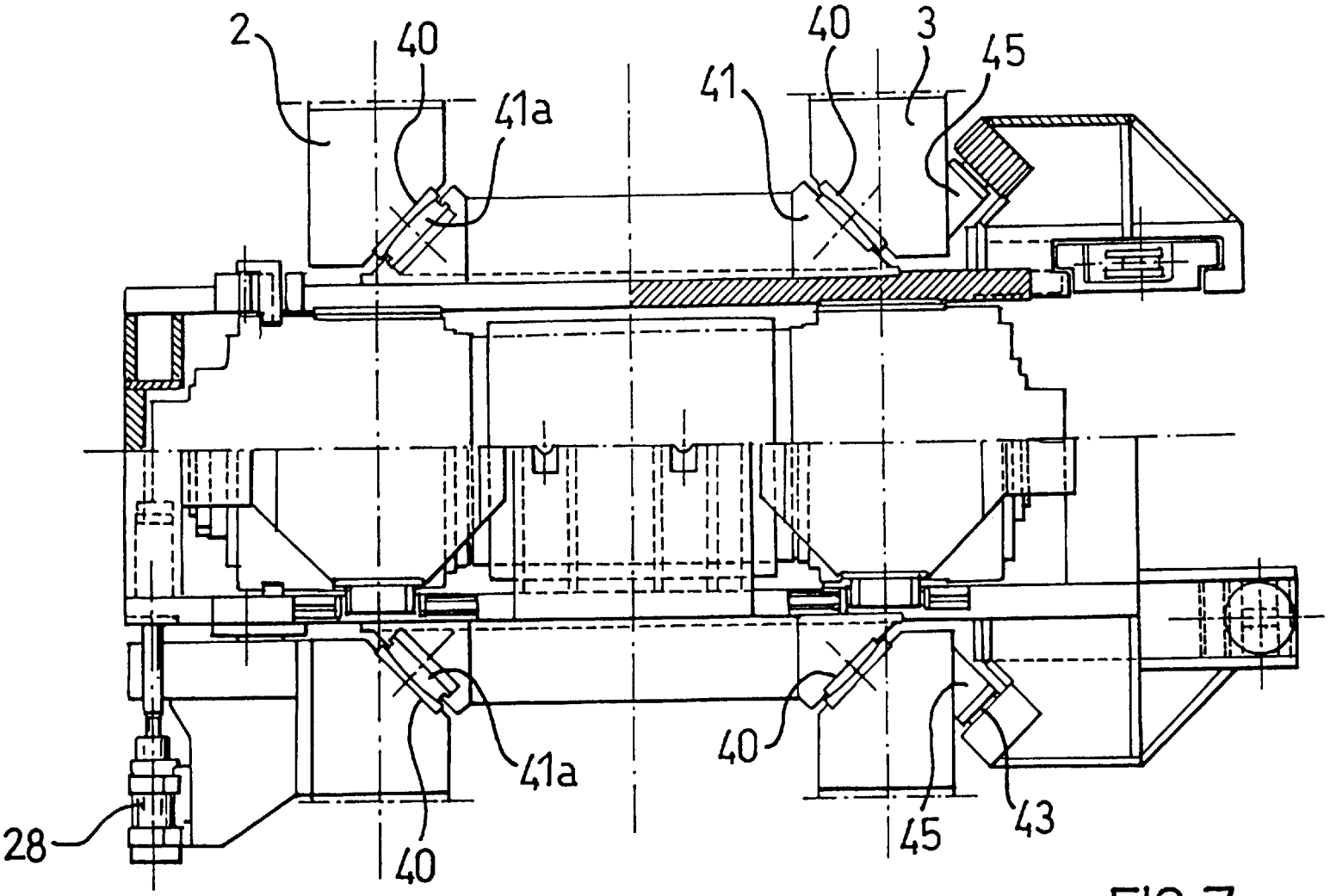
FIG. 7 is a sectional view, along two different planes parallel to that of FIG. 3, of the rolling stand of the invention.

The casing 20 has a substantially box-like shape (see FIG. 5 where, for clarity, the casing is shown with its lateral sides exploded), open towards the base where the working roll 10 is located and laterally to allow the connection of said roll with respective drive means, indicated only by a shaft 32 visible in FIG. 3; it can be observed that in the latter figure the line of intersection of the casing 20 with the plane of the drawing has been shown by cross-hatching in order to facilitate understanding of the drawing.

Figure 4:
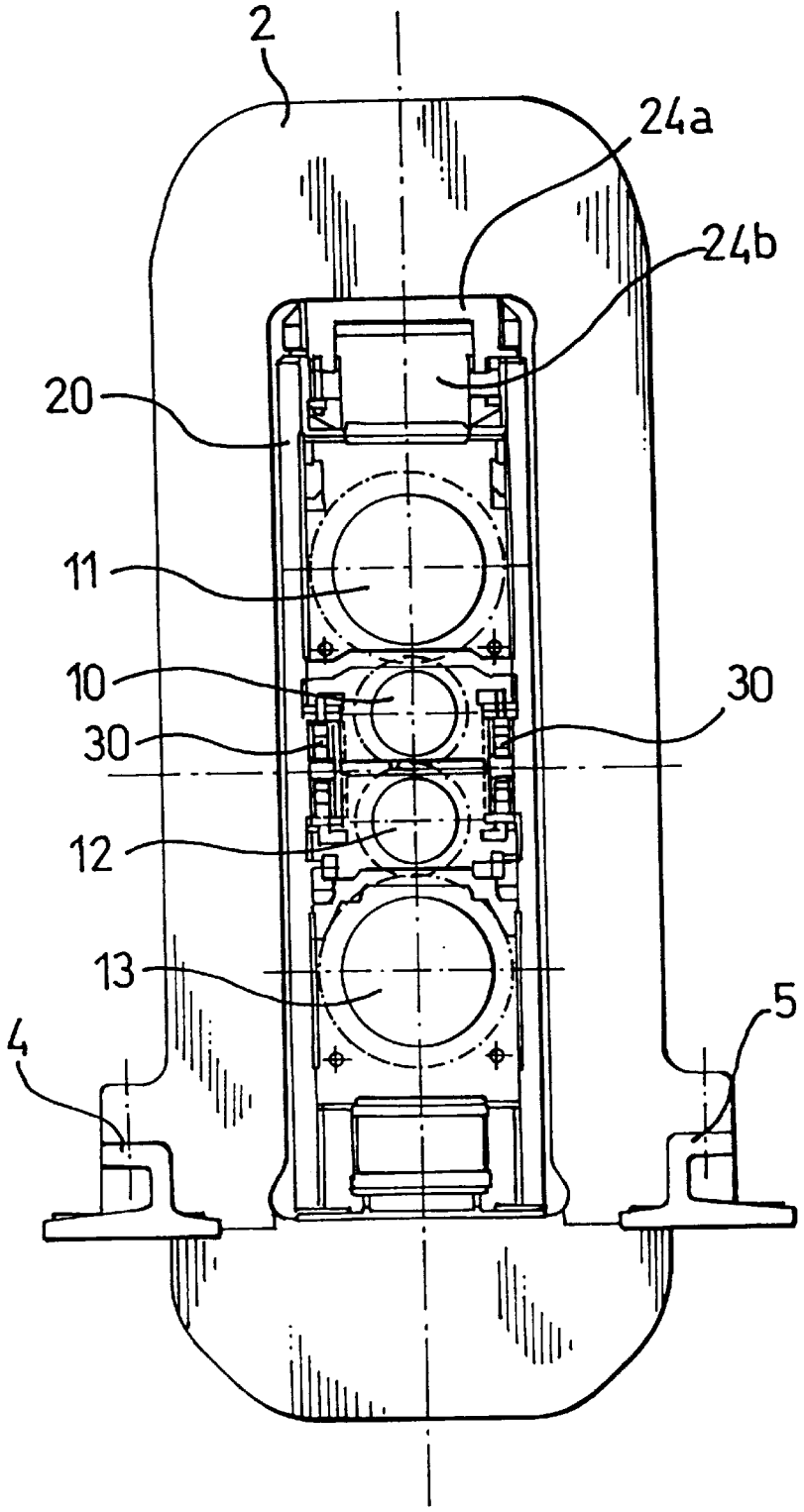
FIG. 4 is a sectional view along line IV—IV in FIG. 2, of the rolling stand referred to above.

The casing 20 is rotatably supported by the frames 2, 3 about the axis of rotation V; in this respect it can be seen from FIGS. 3 and 4 that between the casing 20 and the frames 2, 3 there is enough space to allow the rotations of the casing, which are however of limited amplitude (±1°–2°). Such rotations are operated by two opposed thrust elements 27 and 28, mounted on the frames 2, 3.

On the casing 20 there are also located devices 30 for bending and supporting the working roll 10, consisting of normal hydraulic rams; such devices serve to push upwards the chocks of the working roll (not numbered in the drawings and visible only in FIG. 3) while the actuators 24, 25 (which push downwards) act on the chocks of the back up rolls.

Proceeding now to examine the frames 2, 3 of the structure, they are provided on the side facing the rolls 10–13, with respective chamfered edges where guide surfaces 40 are applied for some blocks 41 projecting from the casing 20.

The surfaces 40 are slightly concave and orientated in such a way that their perpendiculars converge towards the axis V, which in FIG. 3 is identified by the point of intersection of the horizontal direction 0 with the dash-dotted line perpendicular thereto. The reasons for such orientation of the surfaces will be clarified hereinafter, whereas it should be pointed out here that the blocks 41 which are opposite to the frame 2 (those on the left in FIG. 3), are equipped with a platform 41*a* driven hydraulically in order to move between a retracted position wherein the platform is withdrawn into the relative block 41, and an advanced position wherein it exerts a thrust against the corresponding surface 40. These blocks with the related hydraulic platform 41*a* serve for blocking and for taking up slacks once the casing has been rotated into a new position required for rolling. Obviously, as an alternative to this embodiment, the platform 41*a* could be located on the frame 2 of the housing instead that on the casing.

Still for blocking and taking up slacks, externally to the casing 20 there are also mounted two pins 43 which are located opposite to the frame 3 of the housing, i.e. the one which is not affected by the blocks 41 with the hydraulic platform 41*a* mentioned above; said pins are positioned axially by an eccentric 44 of suitable dimensions and driven hydraulically (but could obviously be actuated also in other ways), in order to exert a thrusting action on a corresponding complementary appendage 45 present on the frame 3. According it a preferred embodiment of the invention, the end of the pins 43 pushes against the appendage 45 which is shaped with a curved surface so that the straight line of action of their reciprocal thrust, crosses axis V.

The rolling mill housing 1 under consideration here is moreover of the so-called "shifting" type, that is to say that its working rolls 10 and 12 are provided with the possibility of being translated along their axes.

For this reason the chock of the roll 10 located on the side opposite to that where the drive shaft 32 (see FIG. 3) is fitted, are provided with a pair of slightly divergent arms 47 and 49, on the ends of which there are respectively mounted two freely rotatable wheels 50 and 51; according to a preferred embodiment of the invention, said wheels are mounted in such a way that their axis of rotation is perpendicular to and coplanar with that of the working roll.

The wheels 50 and 51 are engaged in corresponding guide slots 52 and 53, each of which is arranged on a respective slider 54 and 55 mounted at the end of an oleodynamic thrust element 56; the latter is in turn hinged, at its end opposite to the slider, on a projection 60 of the casing 20.

The operation of the rolling stand of the invention, with particular reference to the angular adjustment of the upper rolls 10 and 11 and also to the axial translation of the roll 10, takes places as follows.

Starting from any initial state wherein it is desired to effect a change in the angular position of the rolls, the casing 20 blocked in the structure is released by withdrawing the slacks take-up pins 43 from their advanced position, wherein they exert a thrusting action against the complementary appendage 45 associated thereto.

In such a situation, the casing 20 becomes free to rotate about the axis V under the action of the thrust elements 27, 28, and the action exerted by the surfaces 40 arranged on the chamfered edges of the frames 2 and 3 with regard to the casing 20, becomes relevant: indeed the latter is guided in its rotation by said surfaces which for this reason, are orientated according to what has been explained above.

It just has to be stated here that the assembly 22 is solid in rotation with the casing 20 and is supported by the mounting 23 so as to rotate about it, which instead remains immovable being fixed to the frames 2 and 3.

In practice, the guiding action of the aforesaid surfaces 40 makes it possible to use a reduced number of thrust elements, in this case two, to control the rotation of each casing with maximum precision and extreme simplicity; in fact, owing to this solution it is no longer necessary, as it happens in current applications, to have rigid and precise control of the movements of the thrust elements which rotate the casing, since the rotation of the latter can be guided by the aforesaid surfaces and blocks. Once the casing is set in the new position selected as a function of the angular adjustment desired for the rolls 10 and 11, it is blocked again. This is effected by taking up the inevitable slacks existing between the various components, following to the action on the hydraulic platforms 41*a* and on the pins 43 suitably provided for this purpose, in such a manner as to push them respectively against the related guide surfaces 40 and the complementary appendages 45; in this phase it will be observed the importance of the curved surface of the end of the pins 43 mentioned before, which allows a thrust to be exerted along a straight line of action always passing through the axis V.

With regard to the axial translation (shifting) of the working roll 10, this is controlled by means of the thrust elements 56 which, by extending or retracting, cause the wheels 50, 51 to roll along the related slots 52 and 53: consequently the fitting of the roll 10 which is connected to the above-mentioned wheels by means of the arms 47 and 49, undergoes translational movements in a direction parallel to the axis of the roll 10 which determine corresponding axial displacements of the same.

From what has been disclosed hereinabove, it is possible to understand how the rolling stand according to the invention fulfils the object initially determined for it. Indeed, it can easily be appreciated that by mounting the rolls 10, 11, together with the actuators 24 and 25 on the same rotating support constituted by the casing 20, it now becomes possible to vary the angulation of the aforesaid rolls without changing their position with respect to the actuators and therefore without loading the movable parts 24*b* and 25*b* eccentrically: consequently, the reaction applied by the actuators 24 and 25 on the chocks of the back up roll 11 is always balanced with respect to the bearings, independently of the angular position of rolls and of their distance from the lower rolls 12, 13.

In other words, in the rolling stand of the invention it is no longer necessary to introduce a balancing beam which compensates the stresses arising from the unaligned forces which act on the bearings of the rolls, as occurs instead in the U.S. patent already cited, because now the rolls and the actuators are solid with each other during rotation, therefore being always correctly positioned with respect to one another so as not to generate unbalanced forces on the bearings of the rolls.

The aforesaid result is obtained while achieving at the same time a rolling stand in which the rotation of the casing 20 can take place with great precision and simplicity: this is due to the surfaces 40 and to their function of controlling the casing 20 while it rotates about the vertical axis V, guiding it in the said movement.

It should be pointed out in this connection that the presence of such guide surfaces also makes it possible to limit the number of hydraulic rams or cylinders which are used to perform the required displacements of the casing.

Indeed in the known rolling mills the number of such cylinders is customarily greater than the two used for each casing in the present invention; this is due to the need for effecting the rotation of the casing with precision as stated above: this result is achieved by using a large number of hydraulic cylinders, which are co-ordinated by a complex control and setting system. Since the role of the latter is now fulfilled by the guide surfaces 40, the aforesaid number can be reduced with consequent simplification of the stand and of its control system.

Among the further notable advantages achieved by the invention, it should also be pointed out that the way in which the axial translation of the rolls is obtained, is rather simple and effective.

In order to appreciate this fact it is first necessary to take into account that "shifting" is in general not easy to bring about when, as in this case, the rolls are angularly adjustable; indeed it is clear that by varying the angular position of the rolls, their axial translation is not easy to be carried out because of the changes to which they are subjected. It must indeed be considered the difficulty of producing a mechanism which has to apply a thrust along the axis of rotation of the working roll, even when the arrangement of said axis varies according to the adjustment of its angular position. The axial translation system proposed by the invention overcomes this difficulty because the various mechanisms which serve to push the roll axially, are now mounted on the casing 20 together with the roll and can therefore act independently of its angular position, since they are solid with the roll during its angular movements. It should be stressed that these effects are obtained by virtue of the structural simplicity of the various mechanisms (the arms 47 and 49, the wheels 50 and 51, the sliders 54 and 55) devised to effect the axial displacement of the working roll, which provides for a favourable reduction of their weight and thus allows to mount them on the casing 20 without rendering it excessively heavy.

In this connection it should also be emphasised that by having arranged the wheels 50 and 51 axially coplanar with the relative working roll 10, prevents bending stresses from being generated on the bearings of the working rolls during their axial translational movements and in the course of rolling; indeed, if the wheels were not axially coplanar with the working roll, the thrusts which the latter would transmit axially during rolling (it should be remembered that such thrusts are relevant in the case of rolling with crossed axes) and the related reactions applied by the sliders 54, 55 supported by the thrust elements 56, would produce a bending moment on the roll which could render the correct operation thereof more difficult.

It should therefore be pointed out that the way in which "shifting" is carried out in the rolling stand of the invention allows the application thereof also under load and renders the stand particularly suitable in the case of so-called continuous-continuous rolling i.e. when their is no solution of continuity between the products which are rolled one after the other.

This important result is connected with the capacity of the system consisting of each thrust element together with the related slider coupled to the corresponding wheel, to fit with the different positions assumed by the roll following its axial displacements. Naturally, further embodiments of the invention with respect to what has been described hereinbefore are not to be excluded.

Figure 8:
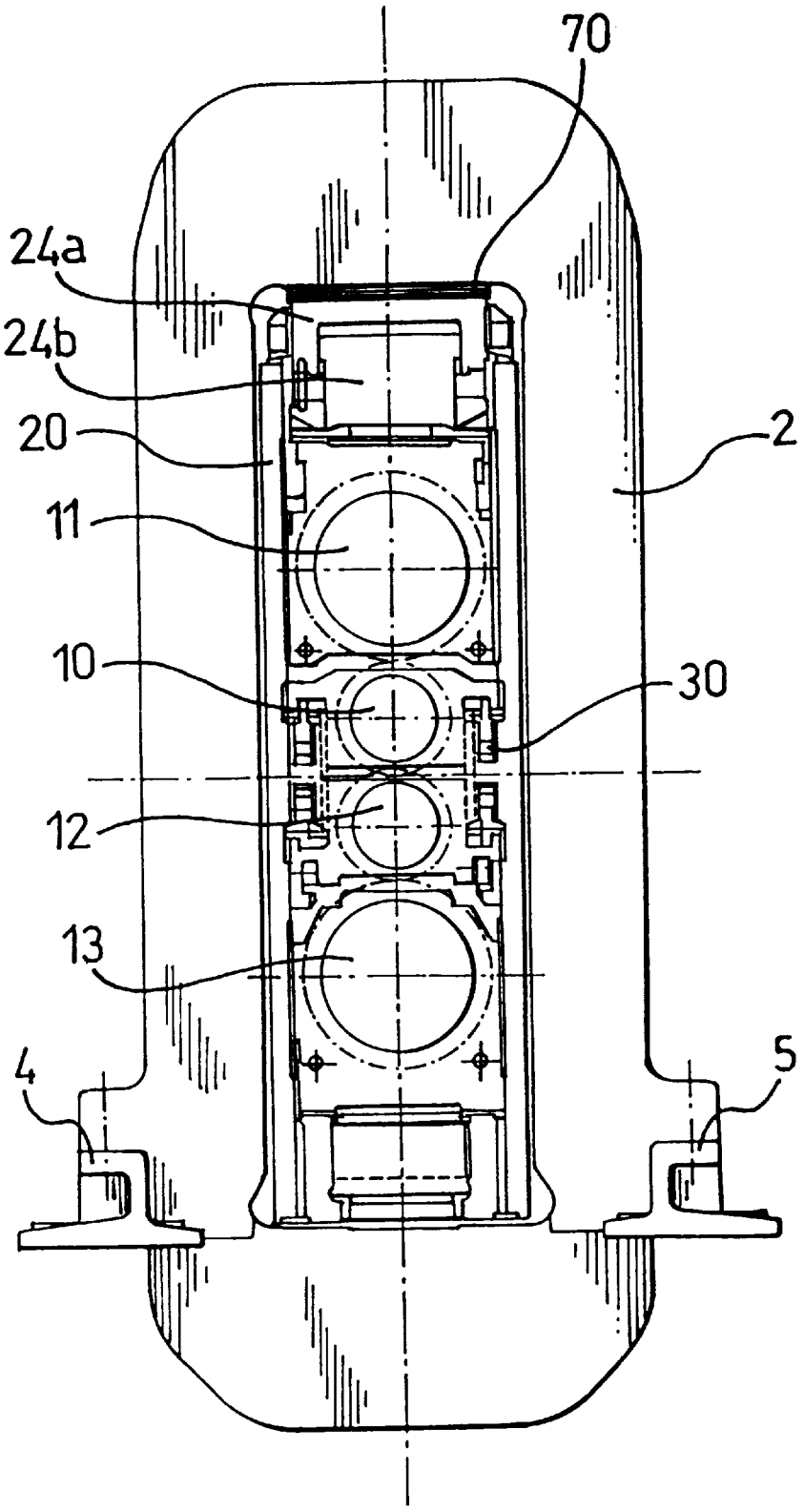
FIG. 8 shows in a view corresponding to that in FIG. 4, a variant of the rolling stand in FIGS. 1 to 7.

One of these is referred to in FIG. 8, where it is shown in a view corresponding to that of FIG. 4; this variant refers to a stand generally similar to the preceding one, with the difference however that it is provided with the possibility of being able to vary the angular position of the rolls also under load, that is to say, during rolling.

In practice, this second embodiment of the invention differs from the first one in that between the fixed parts 24*a*, 25*a* of the actuators 24, 25 and the frames 2, 3 against which the latter respectively act, there are interposed means 70 for the reduction of the horizontal friction forces which would oppose the rotational movements of the casing 20 described above, in the case where these movements took place during the rolling process, such as in the case of adjustment under load of the housing 1.

Such means may be of the type described in British Patent Application GB-A-2 141 959 in the name of Davy McKee and already published, that is to say, a bearing containing a fluid, rollers or balls which transform the sliding friction between the frames 2, 3 and the fixed parts 24*a*, 25*a* into rolling friction, a shim made of rubber, polyurethane or some other suitable resilient material.

For the operation of a similar variant it is advantageous to provide for the platforms 41*a* with the pins 43, intended for blocking and taking up slacks, to be capable of working dynamically according to predetermined patterns (for example a setting ring of force and/or position) as an alternative, or in addition, to a logic of the "on-off" type used in the case of stands without the possibility of adjustment under load. Nor should it be excluded, on the other hand, that in the case of a stand adjustable during rolling, the blocks 41 with the platforms 41*a* and/or the pins 43 might be modified with respect to what has been described previously, or also eliminated and substituted by other means.

As regards other possible changes with respect to what has been stated before, it is clear that although in the rolling stand hereby considered provision has been made for both the upper rolls 10, 11 and the lower rolls 12, 13 to be adjusted angularly, the principles of the invention remain also valid, however, for rolling stands wherein only the upper or lower rolls are provided with a similar possibility of adjustment.

It is also not necessary, in order to implement the invention, that pairs formed by a working roll and a back up roll (pair crossing) be used, but rolling stands could instead be envised wherein each working roll is associated with two or more support rolls.

Similarly, it would also be possible to apply the teaching derived from this invention on stands equipped only with two opposed working rolls, that is, without back up rolls; it will be understood that in the latter case a rolling stand could be made wherein the casing associated with the sole working roll would differ notably from the one above, or be practically eliminated by allowing the actuators 24, 25 to operate directly on the chocks of the roll.

With regard to the particular embodiment of the example described in detail herein, it should be observed that the assembly 22 serves essentially to retain the back up roll 11 when the working roll 10 is removed from the housing in order to be replaced.

However, in the case where solutions other than that under consideration here are adopted, it should not be excluded that the assembly 22 might be eliminated.

These are only some of the numerous variants which it is possible to carry out for the rolling stand of the invention which, being of the crossed roll type, may be produced according to several alternatives, in the light of what has been stated at the beginning of this description. In this respect, it is pointed out that the stand of the invention can find useful application in the field both of cold and hot-rolling mills, and furthermore it may be used for rolling ferrous materials, nonferrous materials and also non-metallic materials: consequently it should not be excluded that it may undergo modifications other than those already discussed, as a function of its wide possibilities of use.

We claim:

1. A rolling stand for flat products, comprising:

a load-bearing structure, an upper working roll, and a lower working roll rotatably supported in opposed position within said structure, at least one of said working rolls being an angularly adjustable roll with its axis that rotates in a plane about a reference axis of the stand perpendicular thereto, and at least one actuator acting on the adjustable roll to set the distance between said adjustable roll and another of said working rolls, wherein the actuator is solid in rotation about the reference axis with the angularly adjustable roll so as to exert on the latter an action independent of its angular position.

2. A rolling stand according to claim 1, wherein said at least one angularly adjustable working roll is associated with at least one back up roll, and wherein such rolls are mounted in a casing supported by the structure of the stand in a rotatable manner with respect to said reference axis and on which casing there is also located said at least one actuator, thereby the angular adjustment of the working roll is obtained by means of the corresponding rotation of the casing about said reference axis.

3. A rolling stand according to claim 2, wherein the roll-carrying casing is guided during its rotation by guide surfaces present on the load-bearing structure of the stand, orientated in such a way as to have the respective perpendiculars passing substantially through the reference axis.

4. A rolling stand according to any one of claims 2 or 3, wherein means are provided for removably blocking the roll-carrying casing in the position assumed by the latter after its rotation about the reference axis (V).

5. A rolling stand according to claim 4, wherein the means for removably blocking the casing comprise a pin and a corresponding complementary appendage arranged one on the roll-carrying casing and the other on the load-bearing structure of the stand, or vice versa, and wherein the pin is capable of exerting a thrust against the complementary appendage according to a line of action passing substantially through the reference axis of the stand.

6. A rolling stand according to claim 5, wherein the means for the removably blocking the casing comprise a platform arranged on the roll-carrying casing in a position opposed to one of the guide surfaces, movable to and fro between an advanced position in which it exerts a thrust on the said guide surface and a retracted position in which it is distanced therefrom.

7. A rolling stand according to claim 1, 2 or 3, comprising means for axially translating said angularly adjustable working roll, said means comprising an arm which extends from one end of the roll and on which there is mounted a freely rotatable wheel axially coplanar with the roll, said wheel being engaged with a slider slidably guided by means solid in rotation with the working roll.

8. A rolling stand according to claim 7, wherein the working roll (10, 12) is mounted in the roll-carrying casing and the means for the guided sliding of the slider are arranged on the casing.

9. A rolling stand according to claim 1, 2 or 3, wherein between said at least one actuator and a part of the load-bearing structure of the housing there are interposed means for reducing the forces which oppose the rotation of the roll for its angular adjustment, during rolling.

10. A rolling stand according to claim 9, comprising means for removably blocking the roll-carrying casing which are adjustable according to a setting ring of position and/or force.

11. A rolling mill for flat products, comprising a plurality of rolling stands according to claim 1, 2 or 3, located along the feeding direction of the product to be rolled.

12. A rolling stand for flat products, comprising:

a load-bearing structure, an upper working roll and a lower working roll rotatably supported in opposed position within said structure, at least one of said working rolls being an angularly adjustable roll with its axis which rotates in a plane about a reference axis of the stand perpendicular thereto, at least one actuator acting on the adjustable roll to set the distance between said adjustable roll and another of said working rolls, means for axially translating said angularly adjustable working roll, and an arm extending from one end of the angularly adjustable working roll and on which there is mounted a freely rotatable wheel axially coplanar with the roll, said wheel being engaged with a slider slidingly guided by means that are solid in rotation about the reference axis with the angular adjustable working roll.

13. A rolling stand according to claim 12, wherein said at least one angularly adjustable working roll is associated with at least one back up roll, such rolls being mounted in a casing supported by the structure of the housing in a rotatable manner with respect to said reference axis and on which casing there are located said means for slidingly guiding the slider.

14. A rolling mill for forming flat products, said mill comprising:

a support frame;

a first roller rotatably supported for rotation about a first axis in said frame;

a second roller rotatably supported in said frame for rotation about a second axis spaced from said first axis, said first roller being angularly adjustable relative to said second roller about a reference axis that extends perpendicularly to both said first and second axes; and an actuator that moves said angularly adjustable first roller relative to said second roller along said reference axis in order to determine a distance between said first and second rollers;

said actuator being mounted in fixed relation with respect to said angularly adjustable first roller such that said first roller and said actuator move together about said reference axis as said first roller is being angularly adjusted, thereby ensuring that the distance between said first and second rollers as determined by said actuator is not affected by the angular adjustment of said angularly adjustable first roller relative to second roller.

* * * * *